US008836593B2

(12) United States Patent
Crowley et al.

(10) Patent No.: US 8,836,593 B2
(45) Date of Patent: Sep. 16, 2014

(54) DIVERSITY FIN ANTENNA

(75) Inventors: Robert J. Crowley, Sudbury, MA (US); Desiree L. Fyler, Needham, MA (US)

(73) Assignee: RF Venue, Inc, Ashland, MA (US)

( * ) Notice: Subject to any disclaimer, the term of this patent is extended or adjusted under 35 U.S.C. 154(b) by 529 days.

(21) Appl. No.: 13/136,452

(22) Filed: Aug. 2, 2011

(65) Prior Publication Data

US 2012/0032861 A1 Feb. 9, 2012

Related U.S. Application Data

(60) Provisional application No. 61/400,847, filed on Aug. 3, 2010.

(51) Int. Cl.

| | |
|---|---|
| ***H01Q 21/00*** | (2006.01) |
| ***H01Q 9/30*** | (2006.01) |
| ***H01Q 11/10*** | (2006.01) |
| ***H01Q 21/24*** | (2006.01) |

(52) U.S. Cl.

CPC ..... *H01Q 9/30* (2013.01); *H01Q 11/105* (2013.01); *H01Q 21/24* (2013.01)

USPC ..... 343/725

(58) Field of Classification Search

USPC ..... 343/725, 792.5

See application file for complete search history.

(56) References Cited

U.S. PATENT DOCUMENTS

| | | | | |
|---|---|---|---|---|
| 4,907,011 | A * | 3/1990 | Kuo | 343/792.5 |
| 5,057,850 | A * | 10/1991 | Kuo | 343/792.5 |
| 7,292,197 | B2 * | 11/2007 | Goldberg et al. | 343/792.5 |

* cited by examiner

*Primary Examiner* — Seung Lee

(74) *Attorney, Agent, or Firm* — Don Halgren

(57) ABSTRACT

A fin-type planar antenna and a deployable dipole antenna are combined into a system as a diversity fin antenna to reduce or eliminate cross polarization fades and dropouts common to wireless audio systems used in theatres, churches and convention centers. A dual feedline connects the diversity fin antenna system to a diversity-equipped receiver in a convenient and rapid manner. The antenna system features broad bandwidth, resistance to deep nulls or fades caused by cross polarization, and an air space dielectric covering provides resistance to detuning in the presence of rain, or touching objects.

10 Claims, 5 Drawing Sheets

DIVERSITY FIN ANTENNA

BACKGROUND OF THE INVENTION

1. Field of the Invention

This invention relates to antenna systems, and more particularly to an antenna system which comprises an orthogonal antenna assembly connected in a relatively fixed arrangement to reduce any cross polarized null condition, and is based upon our Provisional Patent Application No. 61/400,847, filed 3 Aug. 2010, which is incorporated herein by reference in its entirety.

2. Prior Art Discussion

Fin-type antennas employing log periodic dipole arrays and other arrangements of antenna conductors are commonly used for indoor and outdoor reception and transmission of short range wireless signals and particularly so-called wireless audio devices that are used in performance, stage, sports events, houses-of-worship, and in convention halls. The typical prior art fin type antenna is a planar sheet of dielectric material with conductors thereon, and at least one connection point for a coaxial cable. These fin type antennas are capable of operation over a broad bandwidth of 400 MHz to 3000 MHz or greater, and more typically operate over a one or two octave range of 400-1000 MHz, and exhibit forward gain of about 6 dB or more over the entire operating range. Forward gain is a function of the directionality of the antenna. These antennas are linearly polarized, that is, they pick up or transmit RF energy on a single plane, usually a vertical plane.

Wireless devices used in conjunction with typical planar antennas comprise wireless body packs, wireless transducers and microphones of various types, and wireless musical instrument pickups. Wireless monitoring receivers worn by users on stage are included in this group. These wireless devices are typically equipped with linearly polarized antennas, that is, they tend to emit or receive RF energy with a single polarization that is dependent upon the angular position of the device. Because they are linearly polarized, a common problem in operation is a fading or reduction of signal strength when the position of the device results in a crossed polarization of the respective transmitting and receiving antennas. This phenomenon is well known and appreciated in the antenna art. To overcome this problem, which results in an unacceptable noise (white noise) in the received audio, designers have constructed so-called diversity-receive-systems that use a plurality of antennas spaced apart and at different angles, in hope of reducing the probability of an extreme cross polarization fade. The diversity systems use two receivers in one box, typically, with two antenna ports that are to be connected to two feedlines, and then to two antennas. The two antennas can be of various types, most commonly used being the so-called shark fin, or blade antenna named for its flat, fin like shape. These antennas are produced economically by etching printed circuit board materials but have a disadvantage that they may be detuned, reducing effectiveness, when wet with rainwater.

Prior art diversity systems are generally considered to be effective but have the limitations of requiring two antenna setups that may or may not represent true polarization diversity. In other words, even though the visual angle of any two antennas used in such a diversity system may appear to be significantly different and presumably picking up on multiple axes, they may not be in reality due to the vagaries of RF propagation and reflection within buildings and close to reflecting objects such as stage equipment, and other metallic objects nearby. Persons who set up antennas for stage use must experiment with locations and guess at the required position and orientation of two or more antennas used for a single channel, which takes time and is subject to error. In addition the use of two separate antennas often requires the use of two stands that clutter the area, and two divergent feedlines, often coaxial cables, which must be separately routed back to the receiver that has two antenna ports. The cables have to be routed on the floor and usually require taping down for safety.

It would be more convenient, cost-effective, and safer if one antenna system could perform the same function as the two separate antennas of the prior art. More certain diversity operation could be achieved with predetermined, cross polarized elements held in a relatively fixed position, each having its own feedline. More convenient setup and routing of a pair of cables would afford faster deployment and take down if those cables could be routed in parallel, rather than divergently. Deep nulls from cross fades could be reduced or eliminated by the effective antenna system arrangement that would nearly guarantee that a cross-fade condition would have a lower likelihood than with randomly or visually oriented separate antennas. Outdoor operation would be improved if such antenna system was integrated and provided with a way to reduce the effect of water, which is known to detune antennas and reduce performance.

OBJECTS OF THE INVENTION

It is an object of the invention to overcome the limitations described above and provide a convenient, effective and cost effective diversity polarized antenna system with reduced cross polarization null characteristics over a wide frequency range. It is another object of the invention to provide a first planar antenna in a relatively fixed relationship to a second cross polarized antenna and provide convenient attachment points to the first planar antenna and the second cross polarized antenna so they may be used with a diversity receiver. It is another object of the invention to provide for a second independent antenna system that remains in an offset position relative to a first planar antenna, and which permits the folding of the second independent antenna for transportation and storage.

In one aspect, the second antenna is a pair of whip antennas mounted so they may be positioned perpendicular to the first planar antenna. In another aspect, the pair of whip antennas may be adjusted for a specific frequency. In one embodiment, the second independent antenna is an articulated log periodic dipole array (LPDA) that may be folded nearly flat for transportation and storage, and that has a feed point distinct and separate from the first planar antenna. In another embodiment, the diversity antenna system comprises a dielectric cover designed to maintain an air space for the purpose of reducing water detuning. The invention also comprises the method of providing an integrated, diversity polarization antenna comprising a plurality of linear polarized antennas, one of which is a generally planar supporting panel, attaching via coaxial cables the diversity polarization antenna to a diversity receiver, and receiving at the terminals of the receiver signals that are adequate for clear audio at least one antenna terminal of the diversity receiver regardless of the polarization of the desired signal.

BRIEF SUMMARY OF THE INVENTION

The invention thus comprises a method of reducing a cross polarized null condition in a wireless diversity antenna system comprising one or more of the steps of arranging two electrically independent orthogonal antenna elements supported in a relatively fixed position with respect to one another on a flat substrate panel; connecting a first signal line and a second signal line, each from an independent element, to a diversity receiver having a multiple input arrangement; and positioning the two orthogonal antenna elements relative to a proximate radio frequency source, wherein the likelihood of any cross polarization nulls is reduced at the input of the diversity receiver at any moment in time. The independent orthogonal elements may be comprised of whip antennas. The independent orthogonal elements may be comprised of a gain-type planar circuit board antenna. The method may include: folding the antenna elements with respect to the flat substrate panel for transportation thereof.

The invention also comprises an antenna system having a plurality of independent antenna elements mounted on a generally trapezoidally-shaped planar support, each antenna element being electrically separate from one another and physically oriented generally perpendicular to each other, comprising: a first planar antenna serving as a substrate for a directional log periodic type antenna, and a second antenna oriented perpendicularly to the first antenna and affixed thereto, and a first coaxial cable connection on the substrate electrically connected to the directional log periodic type antenna, and a second coaxial cable connection mounted on the substrate which is electrically isolated from the directional log periodic type antenna and is connected to a perpendicular element extending from the substrate, and is positionable into a fixed orthogonal orientation relative thereto. The first planar antenna may be a circuit board type antenna. The system may be comprised of a flat antenna and two positionable whip antennas. The second perpendicular antenna may be comprised of movably hinged elements. The hinged elements are each preferably comprised of a planar etched circuit board.

DETAILED DESCRIPTION OF THE DRAWINGS

Figure 1:
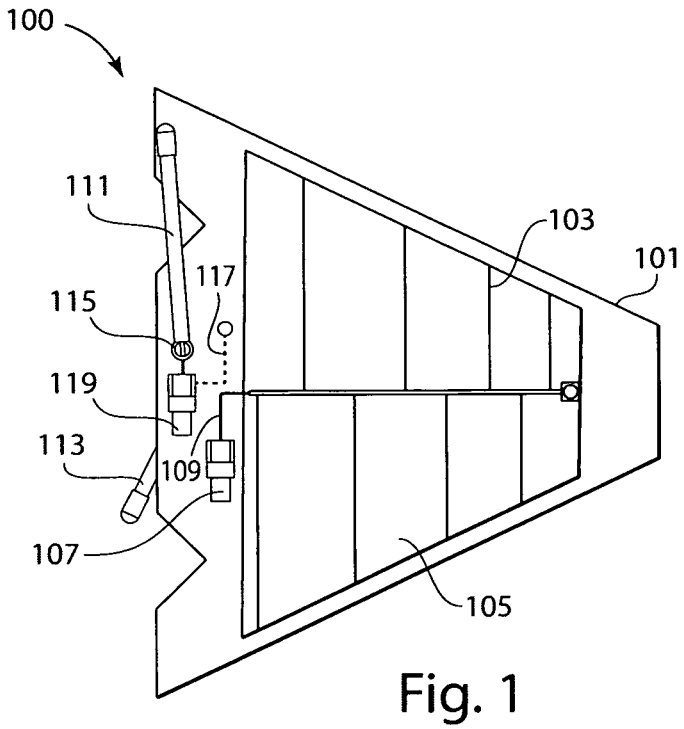
FIG. 1 is a side view of a diversity fin antenna with folded whip elements.

Referring to the drawings in detail, and particularly to FIG. 1, there is shown a side view of a diversity fin antenna 100 with folded whip elements, with a substrate panel 101 which may be comprised of epoxy fiberglass material commonly known as "FR4" which is typically used for printed circuit board applications. Panel 101 is a sandwiched or clad material having copper layers upon dielectric layer(s) that are etched into a pattern or circuit. The particular pattern or circuit can form an antenna patch 103 that may have various shapes, including the shape of a tapered antenna, more commonly known as a log periodic dipole array or LPDA. Elements 105 in patch 103 may be comprised of lines and various shapes that connect to feed line 109 that is further communicates a radio frequency (RF) signal to connector 107. Elements 105 are conductors that are excited by external RF fields, and exhibit directional characteristics, and are polarized with respect to the RF field. Shown here in FIG. 1 is a "vertical" arrangement of antenna elements 105 that are best at picking up RF signals that are also vertically polarized. Still referring to FIG. 1, second whip antennas 111 and 113 are connected through separate circuit 117 that is independent of connector 107 but instead communicates through connector 119. Connector 119 can be a panel mount "BNC" type connector. Whip antennas 111 and 113 may be equipped with pivoting joints 115 to allow for the articulation of antennas 111 and 113.

Figure 2:
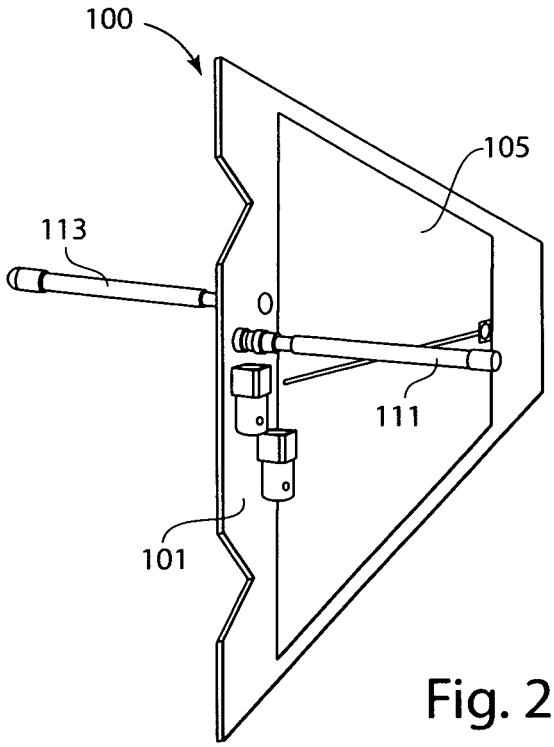
FIG. 2 is a ¾ view of a diversity fin antenna with extended whip elements.

Referring now to FIG. 2, the ¾ view of a diversity fin antenna 100 with extended whip elements, extended whips 111 and 113 can be seen deployed at a more or less right angle to the plane of the substrate panel 101. It can be readily appreciated that extended whips 111 and 113 are polarized at or about 90 degrees from the previously called vertical arrangement of antenna elements 105. Thus, whips 111 and 113 may be thought of as being horizontally polarized, or better able to pick up RF signals that are also horizontally polarized. Extending elements in perpendicular orientation is also desirable for the purpose of maintaining normal operation of the antenna patch 103 without disturbance from the second antenna whips 111 and 113, as the RF coupling between cross polarized elements is minimal thereby allowing them to operate independently yet in close proximity to each other.

Figure 3:
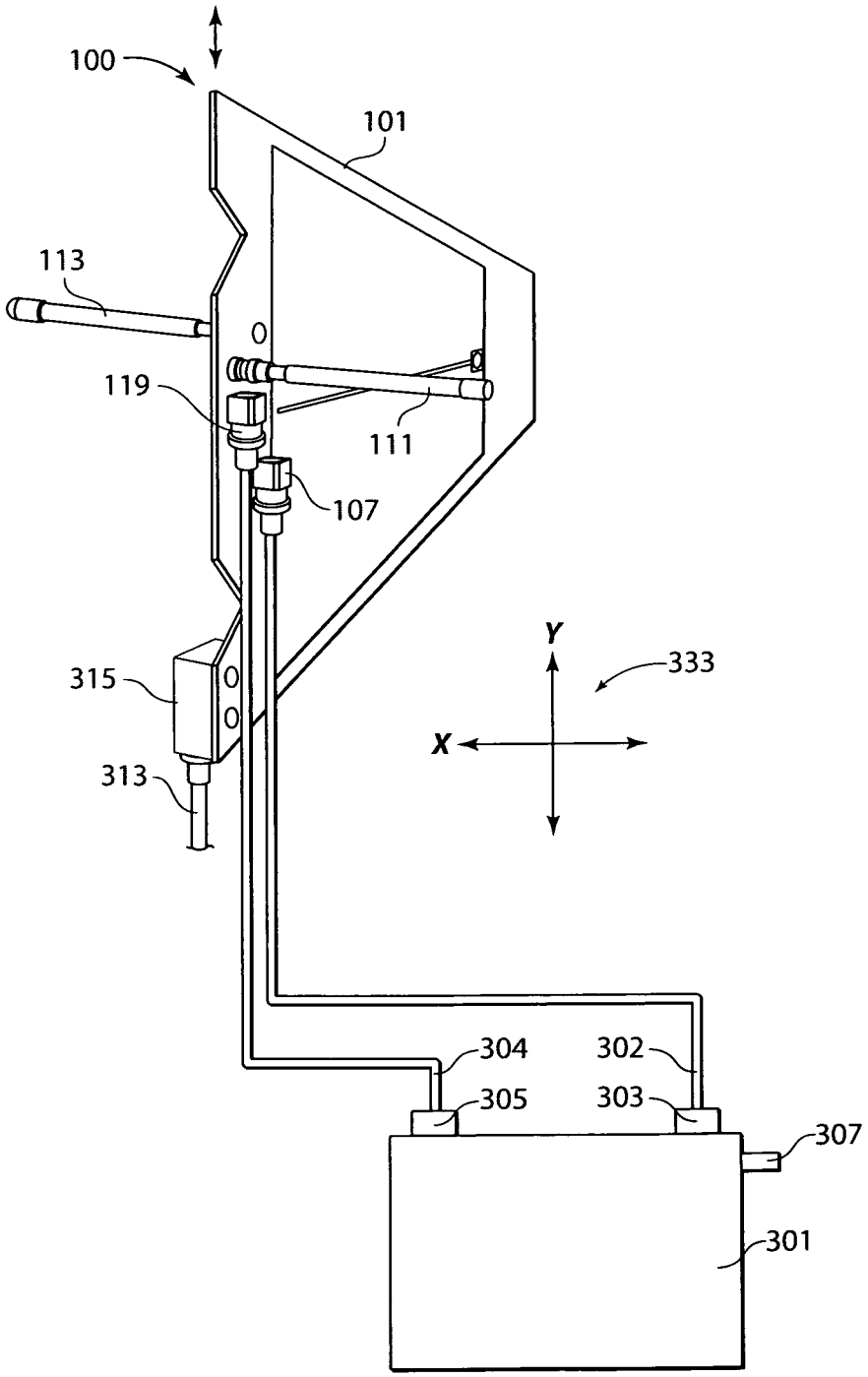
FIG. 3 is a diagram of the connections to the diversity fin antenna, the feedlines, and the connection to a diversity receiver.

Now referring to FIG. 3, a diagram of the connections to the diversity fin antenna 100, the feedlines, and the connection to a diversity receiver 301 is shown. The operation of the diversity fin is enabled as follows: Panel 101 is first mounted on a suitable mast 313 using a block with a tapped hole 315 which is screwed to panel 101. Various stands and attachment schemes can be used, and the panel can be mounted in any position, the "vertical" position shown in FIG. 3 being merely an example. Once mounted, whip antennas 111 and 113 may be extended to a more or less perpendicular position with respect to panel 101. Diversity receiver 301, which may be a typical wireless performance receiver having diversity reception such as for example, a Shure SLX4 Diversity Receiver, or any diversity receiver for any frequency of operation, is then attached via coaxial cables 302 and 304 to antenna ports 305 and 303 on receiver 301. The distal ends of coaxial cables 302 and 304 are connected to independent connectors 107 and 119, thereby connecting in a convenient, fast and sure manner two operable linearly polarized antennas that work in conjunction with each other spaced in a fixed relative position and relative angular position.

Referring again to FIG. 3, the diversity fin antenna 100 is aimed at RF source 333 which may have radiation therefrom at any radial angle such as X, Y, or in between, without concern by the user, since at least one of the two planar axes will always satisfy the condition of not being cross polarized. That is to say, at least one of the two planar axes defined by diversity fin 100 will accommodate and pick up signals if they do arrive in a cross polarized condition, because a perfect undesired cross polarized condition will no longer be produced at both terminals of the diversity receiver 301 when the diversity fin antenna 100 is configured and attached thereto, as shown. Therefore at least one terminal of receiver 301 will always have a signal received within the preferred plane of at least one of the elements of diversity fin 100, being either from whips 111 and 113, which together form a dipole antenna that is generally perpendicular to panel 101, or from elements 105 in patch 103 that are coplanar and parallel to panel 101.

Figure 4A:
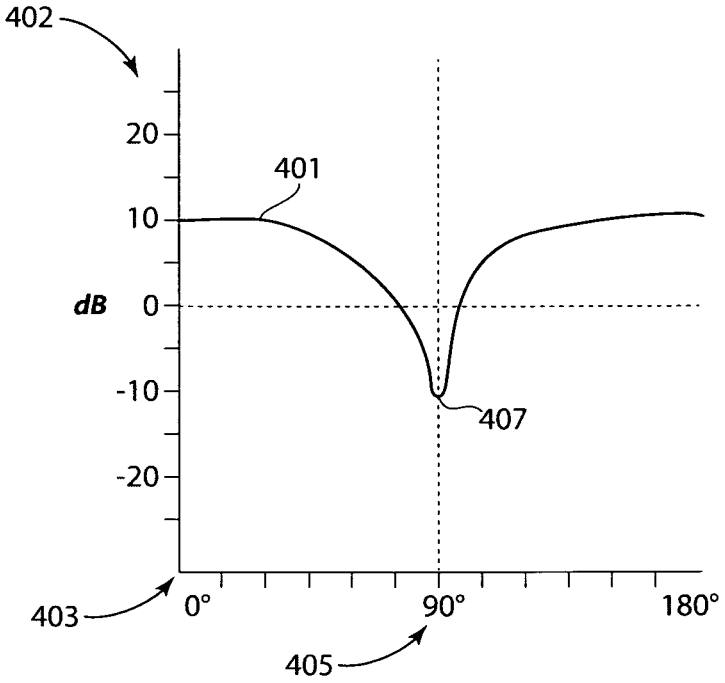
FIG. 4*a* is a graphic representation of the signal from a single cross polarized antenna response when received from a single linear polarized source, showing an undesired null condition as a function of angle of about 90 degrees.

Referring now to FIG. 4*a*, a graphic representation of the signal from a single cross polarized antenna response when receiving from a single linear polarized source, showing undesired null condition as a function of angle of about 90 degrees, the shortcomings of using just a single linear polarized antenna and moving source can be appreciated. Signal level as a function of angle 401 may be expressed as decibels on vertical axis 402. Relative angle axis 403 ranges from 0 degrees to 180 degrees. In Particular, 90 degree relative angle 405 can be seen to correspond to signal null 407 which can and often has a signal strength of 20 decibels below the maximum signal strength if it was otherwise oriented. A loss of 20 decibels is considered to be high, and sufficient to produce a "fade" that can be heard on the received signal as noise.

Figure 4B:
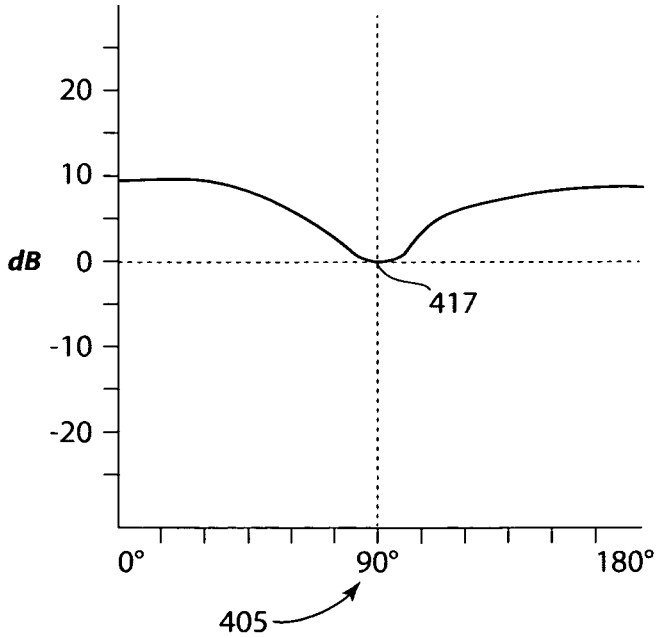
FIG. 4*b* is a graphic representation of the sum of the signals from two perpendicular antenna elements received from a single linear polarized source, even showing an undesired null condition as a function of about a 90 degree angle with its null depth reduced.

Referring now to FIG. 4*b*, which shows a graphic representation of the sum of the signals from two perpendicular antenna elements receiving from a single linear polarized source, even when undesired null condition as a function of about a 90 degree angle is produced, the sum of the two antennas resulting in a situation with the null depth 417 reduced by a good margin, in the order of 10 decibels. In contrast to the null depth described in FIG. 4*a*, the performance of the summed signals of FIG. 4*b* representing the worst case scenario which is a significant and worthwhile improvement in performance, owing to the use of two independent yet relatively fixed, perpendicular, conveniently connectable elements afforded by diversity fin antenna 100 as shown in FIG. 3 in conjunction with diversity receiver 301 also shown in FIG. 3.

Figure 5A:
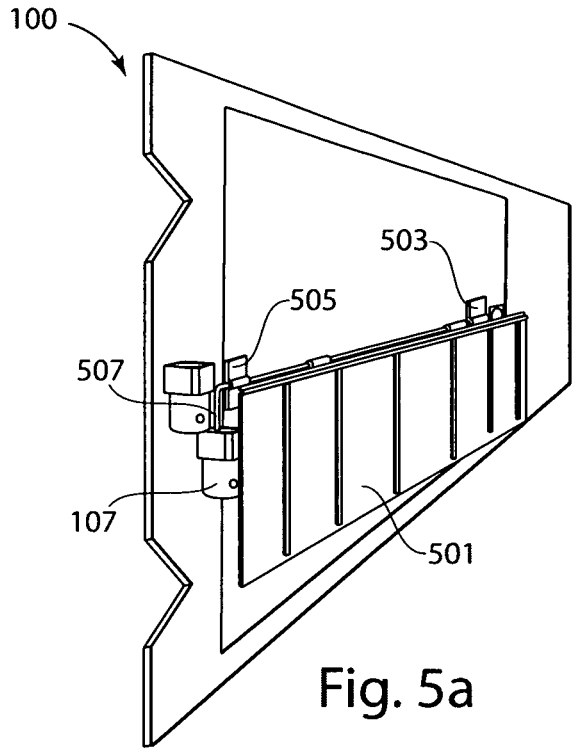
FIG. 5*a* is a ¾ view of a diversity fin antenna with folded array elements.

Referring now to FIG. 5*a*, a ¾ view of a diversity fin antenna with folded array elements, diversity fin antenna 100 may be equipped with a more complex gain-type array element 501 that may be comprised of a planar, etched circuit board material affixed to panel 101 using electrically conductive hinges 503 and 505, which communicate electrically via trace 507 to connector 107. Hinges 503 and 505 may be friction fitted or be provided with detents (not shown) to provide for some stiffness.

Figure 5B:
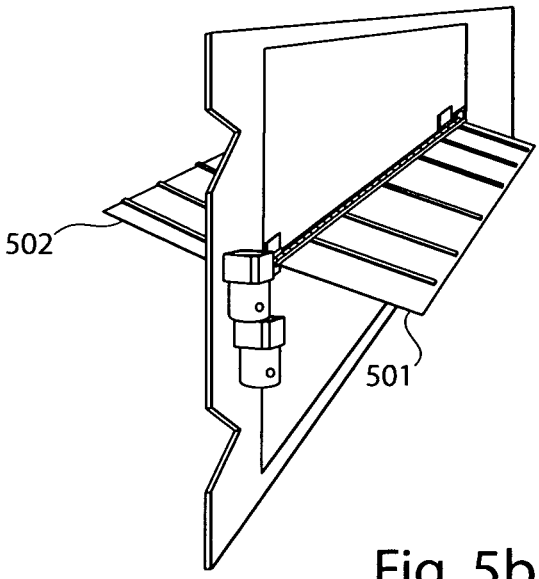
FIG. 5*b* is a ¾ view of a diversity antenna with extended array elements.

Referring now to FIG. 5*b*, a ¾ view of a diversity antenna with extended array elements 501, foldable element 501 and its corresponding panel 502 are shown in the extended position on opposite sides of the panel 101, generally perpendicular to it, and yet deployable at will, and easily stored flat for transportation and storage. The use of array elements 501 and 502 provides gain over the dipoles depicted in FIG. 2, nos. 111 and 113.

Referring back to FIG. 4*b*, the depth of null 417 may be reduced even further, or eliminated altogether, by use of gain elements as depicted in FIG. 5*b* in conjunction with the system depicted in FIG. 3, thereby eliminating dropouts with one, single, quickly deployable antenna system rather than two separate, costly and time consuming antenna setups.

It is recognized that antenna systems as described herein may be used indoors or out of doors, and therefore subjected to rain. Rain on free space elements used in wire type antennas (not shown) has little effect. The coating of water on a planar fin type antenna is more pronounced, having a significant detuning effect and reduction of operating efficiency. In addition, the touching of other objects such as poles, stage equipment and crossing lines are common in performance venues and tend to adversely affect bare or painted shark fin type antennas as commonly used today such as the Lectrosonics ALP500 LPDA Shark Fin Style Antenna.

Figure 6A:
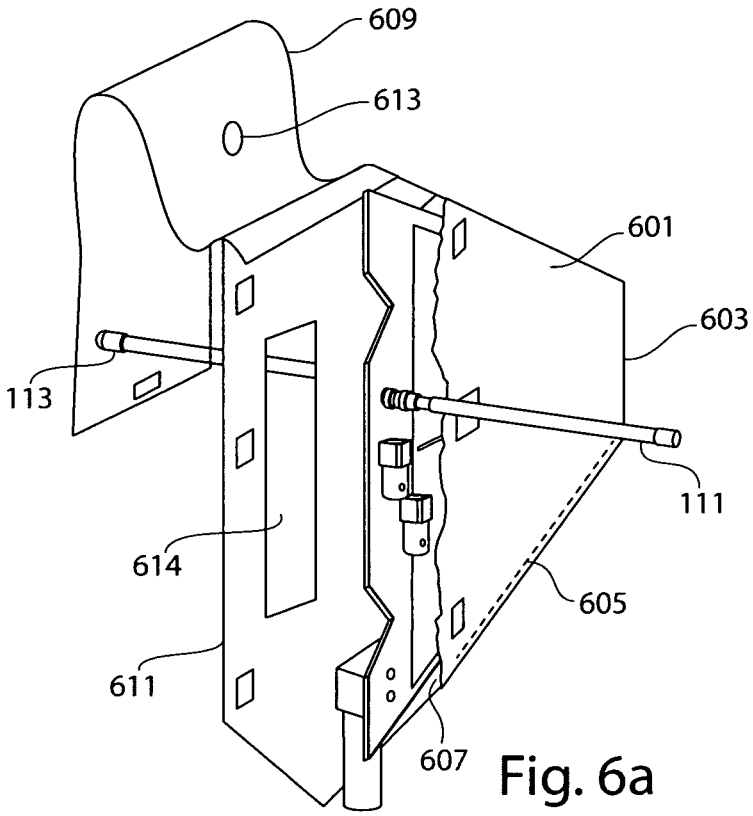
FIG. 6*a* is ¾ view of a dielectric air space hood for a diversity antenna with movable whip elements, with the hood shown in an open position.

Referring now to FIG. 6*a*, there is shown a ¾ view of a dielectric air space hood for a diversity antenna with foldable whip elements 111 and 113 solves the problem of touching objects and rainwater detuning by providing an air space between the wet surface and the flat panel of the antenna patch. Hood 601 may be made of rubberized canvas material having a closed end 603, a tapered sewn edge 605 and an open end 607. Flap 609 and cover 611 allow ready attachment of cables (not shown) to connectors, and may be held in place using hook and loop fasteners for quick deployment. Aperture 613 permits ready connection and extension of whip 111. Aperture 613 may be extended to form a slit, if desired. Second aperture 614 may be provided to gain easy access to connectors.

Figure 6B:
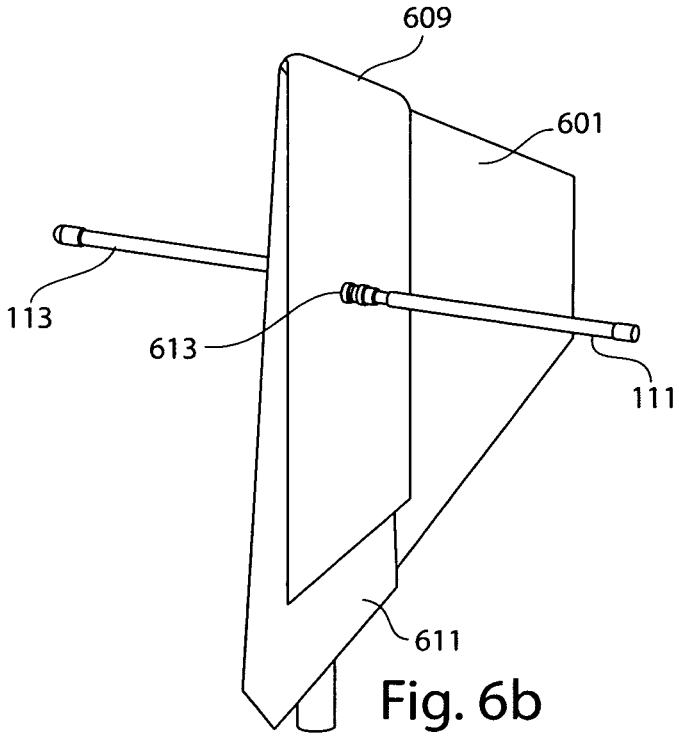
FIG. 6*b* is a ¾ view of a dielectric air space hood for a diversity antenna with movable whip elements, with the hood shown in a closed position.

Now referring to FIG. 6*b*, the hood 601 is so effective at regulating the operation of planar antennas that it could be left in place at all times, protecting the electrical components, thereby reducing the need for rubberized or epoxy painted conformal coatings, and thus keeping rough or sharp edges from persons who may be injured by a falling, uncovered antenna. Flap 609 and cover 611 fold together to form a reasonably water resistant covering with an aperture 613 permitting the attachment of whip antennas 111 and 113. A further advantage of the dielectric air space hood 601 provides for user selectable colors, indicia, advertising, and easy machine wash cleaning.

The diversity fin antenna system thus described has uses as a receiving or a transmitting antenna where fast deployment, and polarization diversity are desired to reduce or eliminate dropouts and undesired noises in concerts, in wireless microphone, bodypack or pickup systems, in convention centers, in presentation stages, houses-of-worship and outdoors such as at sporting events, concerts and other venues. It may also be used in buildings for cellular telephony and for so-called wifi applications, and as portable antenna systems that may be incorporated into tablet type computers, or miniaturized versions may be used for more distant reception and transmission when required by a user.

The invention claimed is:

1. A method of reducing a cross polarized null condition in a wireless diversity antenna system comprising;

arranging two electrically independent orthogonal antenna elements supported in a relatively fixed position with respect to one another on a flat substrate panel;

connecting a first signal line and a second signal line, each from an independent element, to a diversity receiver having an input; and positioning the two orthogonal antenna elements relative to a proximate radio frequency source, wherein the likelihood of any cross polarization nulls is reduced at the input of the diversity receiver at any moment in time.

2. The method as recited in claim 1, wherein the independent orthogonal elements are comprised of whip antennae.

3. The method as recited in claim 1, wherein the independent orthogonal elements are comprised of a gain-type planar circuit board antenna.

4. The method as recited in claim 1, including:

folding the antenna elements with respect to the flat substrate panel for transportation thereof.

5. The method as recited in claim 1, including the step of:

enclosing at least a portion of the antenna elements and substrate panel in a weather protective enclosure hood.

6. An antenna system having a plurality of independent antenna elements mounted on a planar support, each antenna element being electrically separate from one another and physically oriented generally perpendicular to each other, comprising:

a first planar antenna serving as a substrate for a directional log periodic type antenna, and a second antenna oriented perpendicularly to the first antenna and affixed thereto, and a first coaxial cable connection on the substrate electrically connected to the directional log periodic type antenna, and a second coaxial cable connection mounted on the substrate which second coaxial cable connection is electrically isolated from the directional log periodic type antenna and is connected to a perpendicular element extending from the substrate, and is positionable into a fixed orthogonal orientation relative thereto.

7. The antenna system as recited in claim 6, wherein the first planar antenna is a circuit board type antenna.

8. The antenna system as recited in claim 6, which the system comprises a flat antenna and two positionable whip antennas.

9. The antenna system as recited in claim 6, wherein the second antenna is comprised of movably hinged elements.

10. The antenna system as recited in claim 9, wherein the hinged elements are each comprised of a planar etched circuit board.

* * * * *